US008353605B2

(12) United States Patent
Huang et al.

(10) Patent No.: US 8,353,605 B2
(45) Date of Patent: Jan. 15, 2013

(54) WIRELESS NETWORK APPARATUS CAPABLE OF ILLUMINATION

(75) Inventors: Chih-Hua Huang, Shulin (TW); Ching-Feng Hsieh, Taipei (TW)

(73) Assignee: Askey Computer Corp. (TW)

( * ) Notice: Subject to any disclaimer, the term of this patent is extended or adjusted under 35 U.S.C. 154(b) by 149 days.

(21) Appl. No.: 12/975,954

(22) Filed: Dec. 22, 2010

(65) Prior Publication Data

US 2012/0140475 A1 Jun. 7, 2012

(30) Foreign Application Priority Data

Dec. 3, 2010 (TW) ..... 99142122 A

(51) Int. Cl.
*F21V 1/00* (2006.01)
*F21V 11/00* (2006.01)

(52) U.S. Cl. ..... 362/240; 362/253; 362/458

(58) Field of Classification Search ..... 362/240, 362/253, 362, 458, 631–634
See application file for complete search history.

(56) References Cited

U.S. PATENT DOCUMENTS 6,229,507 B1 * 5/2001 Nakamura et al. ..... 345/82

* cited by examiner

*Primary Examiner* — Jason Moon Han
(74) *Attorney, Agent, or Firm* — Schmeiser, Olsen & Watts, LLP

(57) ABSTRACT

A wireless network apparatus capable of illumination includes a casing, a motherboard, a prompting unit, and a light emitting unit. The casing has a light permeable portion. The motherboard is disposed in the casing for serving a networking function. The prompting unit is disposed at the motherboard and electrically connected thereto for generating a prompting signal in accordance with a status of the networking function being performed by the motherboard. The light emitting unit is disposed on the motherboard or in the casing and corresponds in position to the light permeable portion. The light emitting unit is powered by the motherboard and configured to emit light passing through the light permeable portion, thereby serving a lighting function. Accordingly, the wireless network apparatus provides home illumination, increases the value-added, and boosts consumers' willingness to buy and install the wireless network apparatus.

8 Claims, 7 Drawing Sheets

A-A'

WIRELESS NETWORK APPARATUS CAPABLE OF ILLUMINATION

CROSS-REFERENCE TO RELATED APPLICATION

This non-provisional application claims priority under 35 U.S.C. §119(a) on Patent Application No(s). 099142122 filed in Taiwan, R.O.C. on Dec. 3, 2010, the entire contents of which are hereby incorporated by reference.

FIELD OF THE TECHNOLOGY

The present invention relates to wireless network apparatuses, and more particularly, to a wireless network apparatus equipped with light-emitting diodes for illumination.

BACKGROUND

Wireless networking facilities nowadays, such as 3G wireless base stations, are of several types, namely macrocells, microcells, picocells, and femtocells (also known as femtocell cellular base stations or home node bases). Microcells and picocells are used mostly in areas which are densely populated and have a high mobile phone penetration rate, such as train stations, bus stations, and shopping malls, and are configured to increase the networking capacity therein. Femtocells provide a relatively small coverage, and are configured to serve any areas which are not covered by other base stations and increase data transmission speed. In general, femtocells are applicable to residential areas or small commercial districts. Femtocells use broad bands (such as DSL or cables) for connection with the Internet and communication service providers; hence, femtocells are conducive to reduction in the costs incurred by the communication service providers in creating wireless base stations.

However, a femtocell nowadays essentially comprises a casing and a circuit board disposed in the casing and configured for connection with a home user's modem, without serving any other additional functions. Hence, as with modems, femtocells always operate at home unnoticed. Femtocells manufactures anticipate that consumers take the initiative in purchasing femtocells to enhance the quality of indoor coverage of wireless communication. Nonetheless, although doubts about the adverse effective of wireless base stations on the human body was proved unwarranted, consumers remain reluctant to purchase femtocells in the absence of other favorable incentives. As a result, incursion of femtocells into people's living room will be unlikely to happen, unless femtocell manufactures solve the aforesaid problem, that is, inadequate indoor wireless communication coverage.

Accordingly, it is imperative to invent a wireless network apparatus capable of illumination and effective in increasing the value-added of wireless network apparatuses and equipping the wireless network apparatuses with other functions required for human beings in daily life, so as to boost consumers' willingness to buy wireless network apparatuses (such as femtocell cellular base stations).

SUMMARY

In view of the aforesaid drawbacks of the prior art, the inventor of the present invention believes there is still room for improvement in the prior art, and thus the inventor conducted extensive researches and experiments according to the inventor's years of experience in the related industry, and finally developed a wireless network apparatus capable of illumination as disclosed in the present invention with a view to providing home illumination, increasing the value-added of the related products, and boosting consumers' willingness to buy and install the wireless network apparatus.

It is a primary objective of the present invention to provide a wireless network apparatus capable of illumination and equipped with a light emitting unit for emitting light when in operation with a view to providing home illumination, increasing the value-added of the related products, and boosting consumers' willingness to buy and install the wireless network apparatus.

In order to achieve the above and other objectives, the present invention provides a wireless network apparatus capable of illumination, comprising: a casing having a light permeable portion; a motherboard disposed in the casing for providing the networking function; a prompting unit disposed at the motherboard and electrically connected thereto for generating a prompting signal in accordance with a status of the networking function being performed by the motherboard; and a light emitting unit disposed on the motherboard, positioned in a way to correspond in position to the light permeable portion, powered by the motherboard, and configured to emit light that passes through the light permeable portion so as to provide the lighting function.

The light permeable portion comprises a plurality of through holes on the surface of the casing according to a preferred embodiment of the present invention.

The light permeable portion is a light permeable shade disposed on the casing according to a preferred embodiment of the present invention.

In a preferred embodiment of the present invention, the light emitting unit comprises a plurality of first light-emitting diodes (LED) disposed on at least one of the front side and the rear side of the motherboard, and the prompting unit comprises a plurality of second light-emitting diodes, such that a light ray emitted from the second light-emitting diodes functions as the prompting signal.

In a preferred embodiment of the present invention, the light emitting unit comprises a circuit substrate and at least one said first light-emitting diode coupled to the circuit substrate and corresponding in position to the light permeable portion, wherein the circuit substrate is fixedly coupled to the motherboard.

In another preferred embodiment of the present invention, the wireless network apparatus capable of illumination comprises: a casing having a light permeable portion; a motherboard disposed in the casing for providing the networking function; a prompting unit disposed at the motherboard and electrically connected thereto for generating a prompting signal in accordance with a status of the networking function being performed by the motherboard; and a light emitting unit comprising a circuit substrate and at least one said first light-emitting diode coupled to the circuit substrate fixedly coupled to the casing from inside, positioned in a way to correspond in position to the light permeable portion, and configured to emit light passing through the light permeable portion so as to provide the lighting function.

The light permeable portion comprises a plurality of through holes on the surface of the casing according to the above preferred embodiment of the present invention.

The light permeable portion is a light permeable shade disposed on the casing according to the above preferred embodiment of the present invention.

In the above preferred embodiment of the present invention, the prompting unit comprises a plurality of second light-emitting diodes, and a light ray emitted from the second light-emitting diodes functions as the prompting signal.

In the above preferred embodiment of the present invention, the light emitting unit further comprises a plurality of second light-emitting diodes (LED) disposed on at least one of the front side and the rear side of the motherboard. The second light-emitting diodes correspond in position to the light permeable portion and emit light that passes through the light permeable portion for providing the lighting function.

Accordingly, a wireless network apparatus having a lighting function according to the present invention can be connected to a modem installed indoors and enables (by means of a switch disposed on the surface of the wireless network apparatus) users to independently control the light emitting unit in terms of operation (ON/OFF) and brightness (brightest/moderate/dim) such that the wireless network apparatus provides home illumination, increases the value-added, and boosts consumers' willingness to buy and install the wireless network apparatus.

BRIEF DESCRIPTION OF THE DRAWINGS

To enable persons skilled in the art to fully understand the objectives, features, and advantages of the present invention, the present invention is hereunder illustrated with specific embodiments in conjunction with the accompanying drawings, in which.

DETAILED DESCRIPTION

Figure 1:
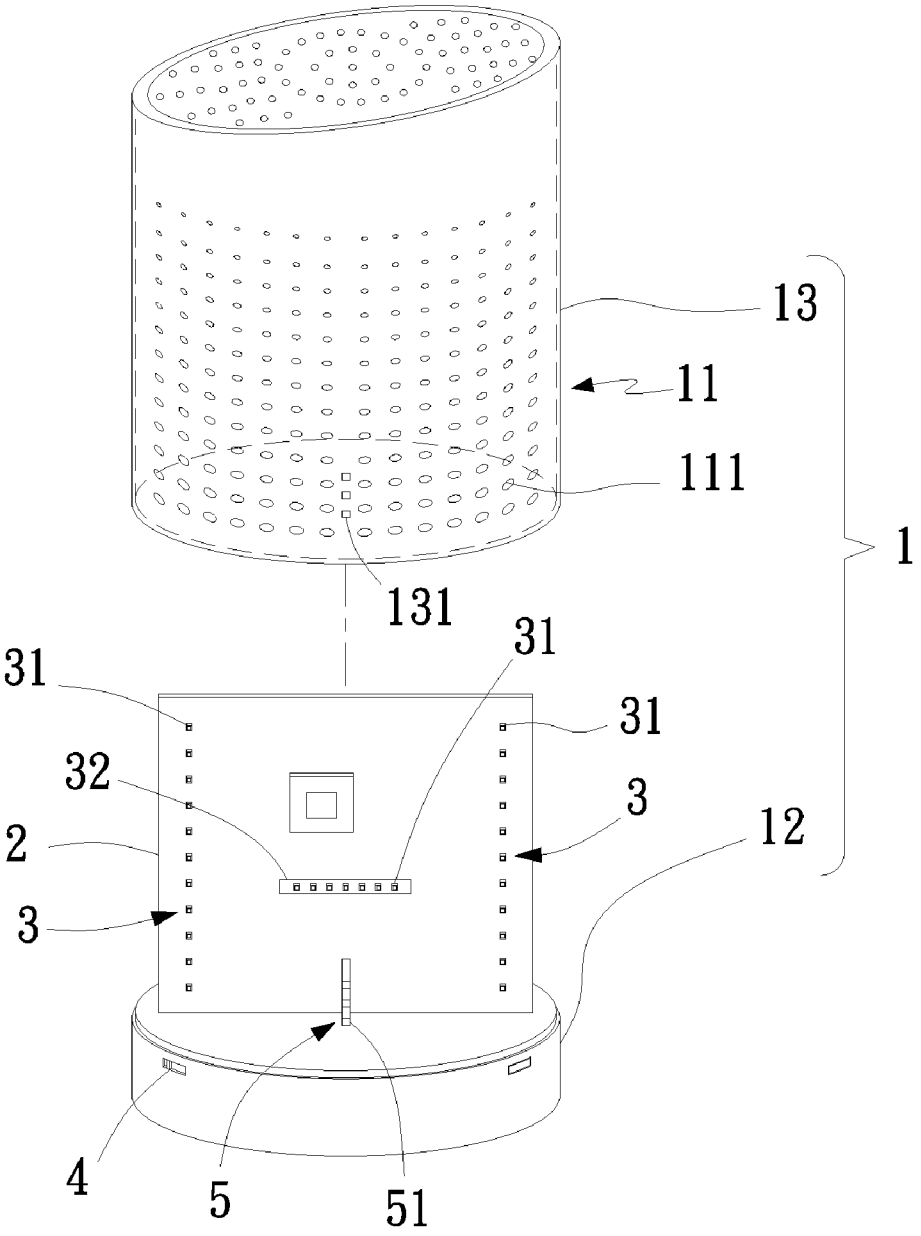
FIG. 1 is an exploded perspective view of a wireless network apparatus capable of illumination according to a first preferred embodiment of the present invention.
Figure 2:
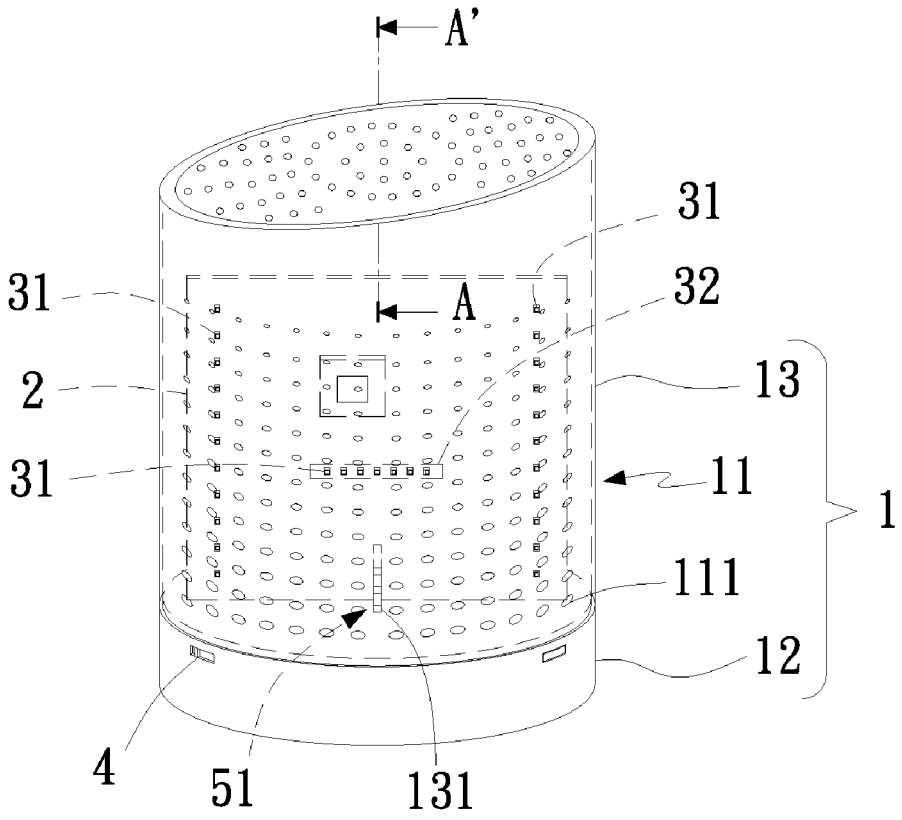
FIG. 2 is a perspective view of the wireless network apparatus when assembled according to the first preferred embodiment of the present invention.
Figure 3:
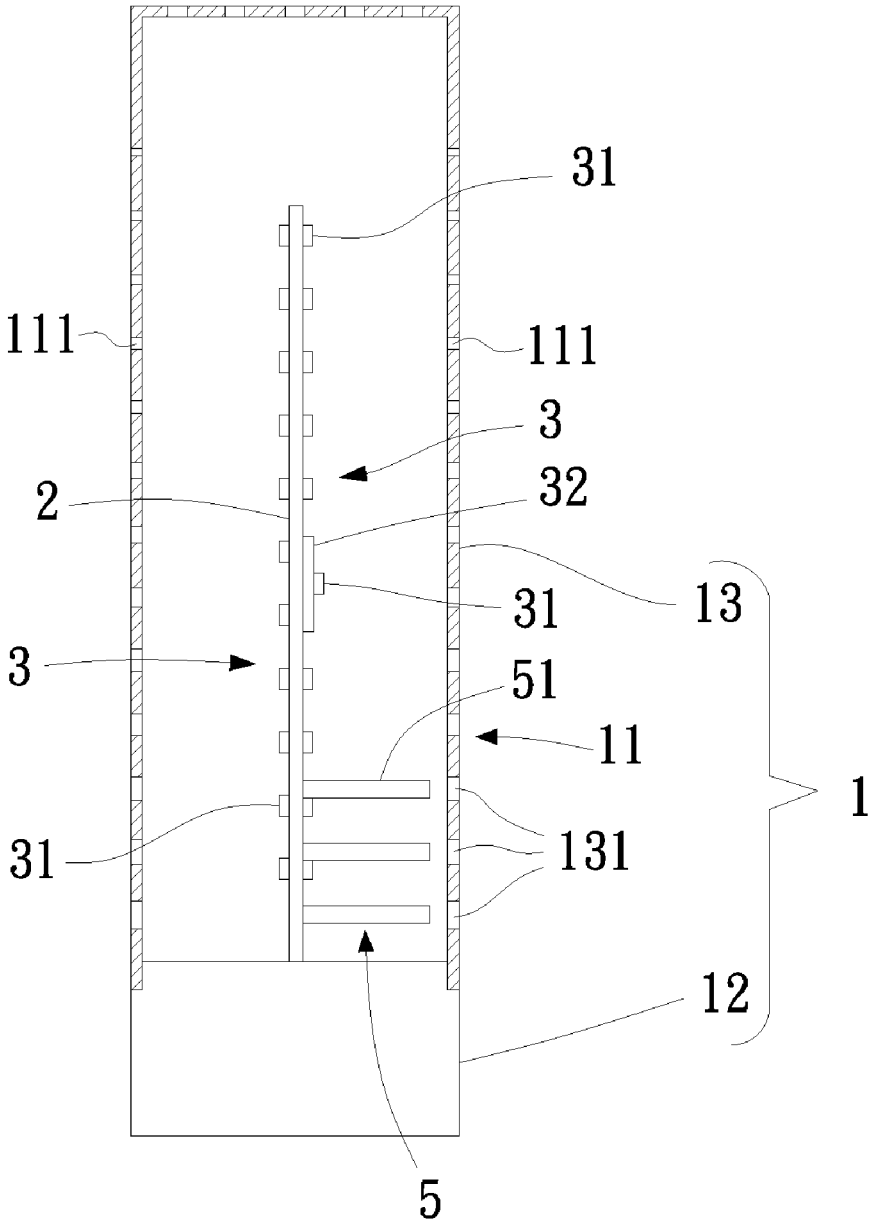
FIG. 3 is a cross-sectional view of the wireless network apparatus when assembled according to the first preferred embodiment of the present invention.

Referring to FIG. 1, FIG. 2 and FIG. 3, a wireless network apparatus capable of illumination according to the first embodiment of the present invention comprises a casing 1, a motherboard 2, a prompting unit 5, and a light emitting unit 3.

The casing 1 has a light permeable portion 11, a base 12, and a cover 13 with a hollow core. In a preferred embodiment, the light permeable portion 11 comprises a plurality of through holes 111 on the surface of the casing 1, or is a light permeable shade disposed on the casing 1 in whole or in part.

The motherboard 2 is disposed in the casing 1 for providing a networking function and is, in a preferred embodiment, a motherboard for use in femtocells or other wireless base stations.

The prompting unit 5 is disposed on and electrically connected to the motherboard 2 for generating a prompting signal in accordance with a status of the networking function being performed by the motherboard 2. In a preferred embodiment, the prompting unit 5 comprises a plurality of second light-emitting diodes 51. A light ray emitted from the second light-emitting diodes 51 functions as a prompting signal. In practice, the prompting unit 5 serves to inform the user of the status of the networking function being performed by the wireless network apparatus, and the prompting signal informs the user of the function being performed by the wireless network apparatus. For example, power indicator light indicates that the apparatus is operating, and networking indicator light indicates that the apparatus is providing a wireless network-based transmission function. The prompting signal from the second light-emitting diodes 51 is observable through a through hole 131 of the casing 1.

The light emitting unit 3 is disposed on the motherboard 2, positioned in a way to correspond in position to the light permeable portion 11 of the casing 1, powered by the motherboard 2, and configured to emit light that passes through the light permeable portion 11 so as to provide a lighting function. In a preferred embodiment, the light emitting unit 3 comprises a plurality of first light-emitting diodes (LED) 31 disposed on at least one of the front side and rear side of the motherboard 2. In an alternative embodiment, the light emitting unit 3 comprises a circuit substrate 32 and at least one said first light-emitting diode 31 coupled to the circuit substrate 32. The at least one said first light-emitting diode 31 is fixedly coupled to the motherboard 2 through the circuit substrate 32 in a way that the at least one said first light-emitting diode 31 corresponds in position to the light permeable portion 11 of the casing 1. In so doing, the wireless network apparatus of the present invention has a lighting function.

Figure 4:
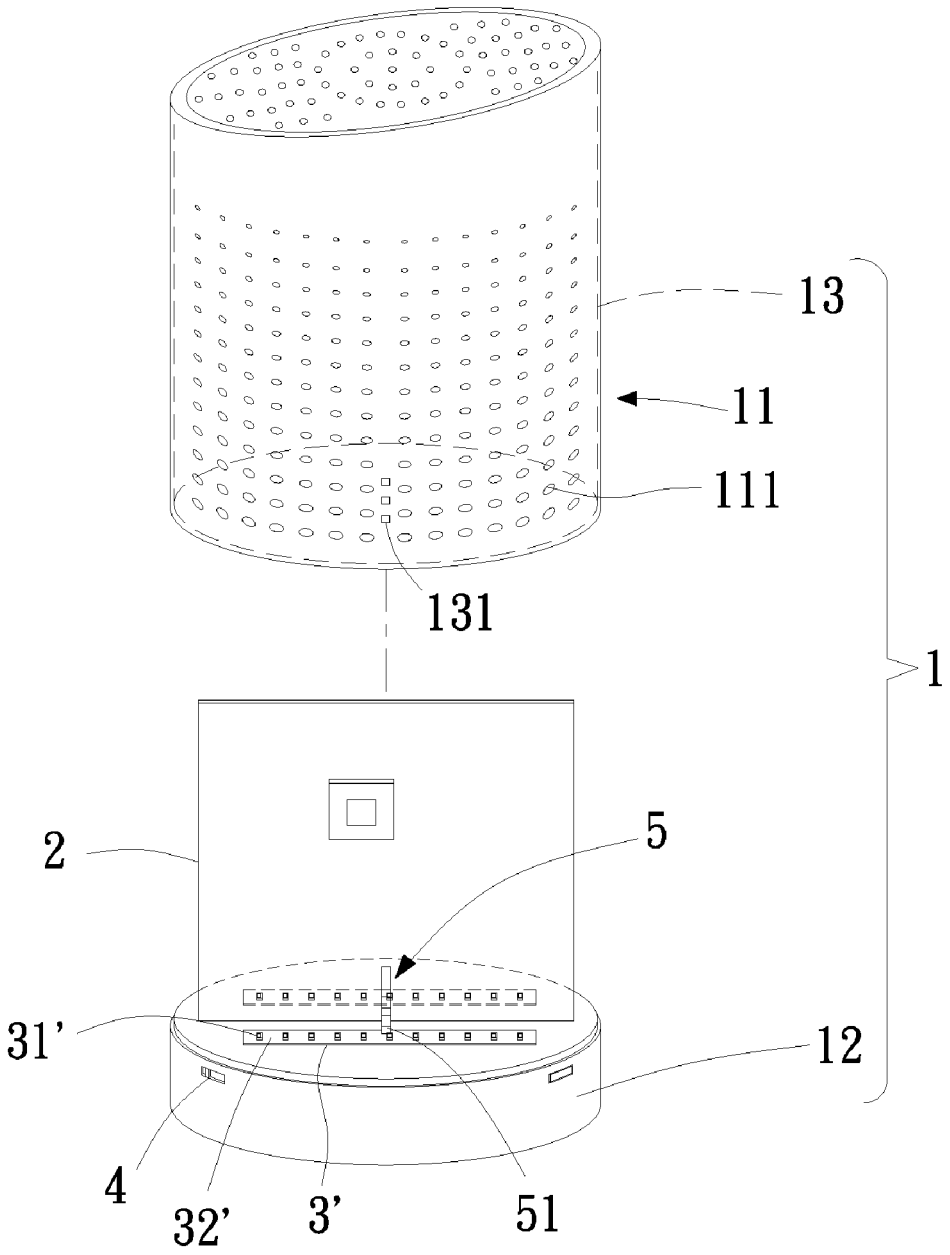
FIG. 4 is an exploded perspective view of a wireless network apparatus capable of illumination according to a second preferred embodiment of the present invention.
Figure 5:
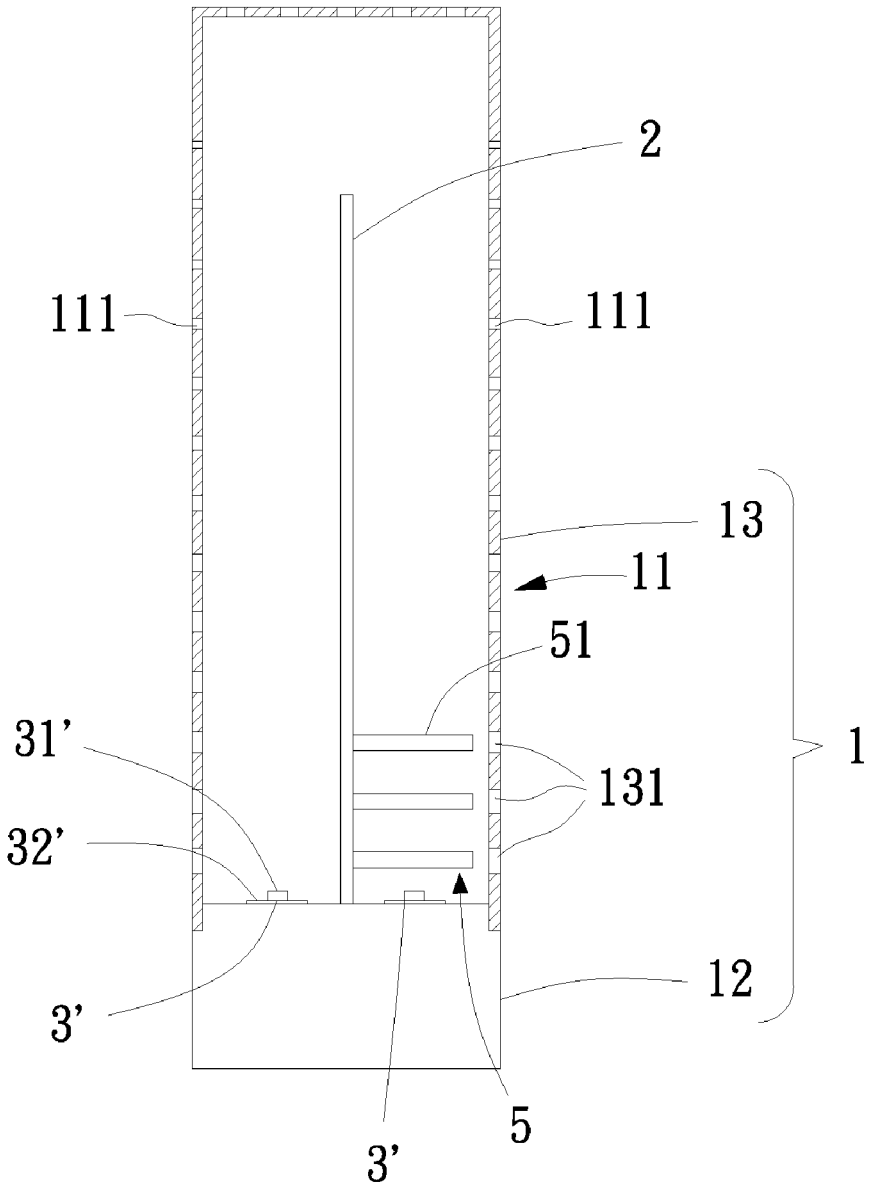
FIG. 5 is a cross-sectional view of the wireless network apparatus when assembled according to the second preferred embodiment of the present invention.

Referring to FIG. 4 and FIG. 5, in the second embodiment of the present invention, the wireless network apparatus having a lighting function comprises the casing 1, the motherboard 2, the prompting unit 5, and a light emitting unit 3'. The second embodiment is the same as the first embodiment in terms of the casing 1, the motherboard 2, and the prompting unit 5. However, in the second embodiment, the light emitting unit 3' comprises a circuit substrate 32' and at least one of a plurality of first light-emitting diode 31' coupled to the circuit substrate 32'. The circuit substrate 32' is fixedly coupled to the casing 1 from inside. The at least one said first light-emitting diode 31' corresponds in position to the light permeable portion 11 of the casing 1. The at least one said first light-emitting diode 31' emits light that passes through the light permeable portion 11 for providing a lighting function. In so doing, the wireless network apparatus of the present invention has a lighting function.

Figure 6:
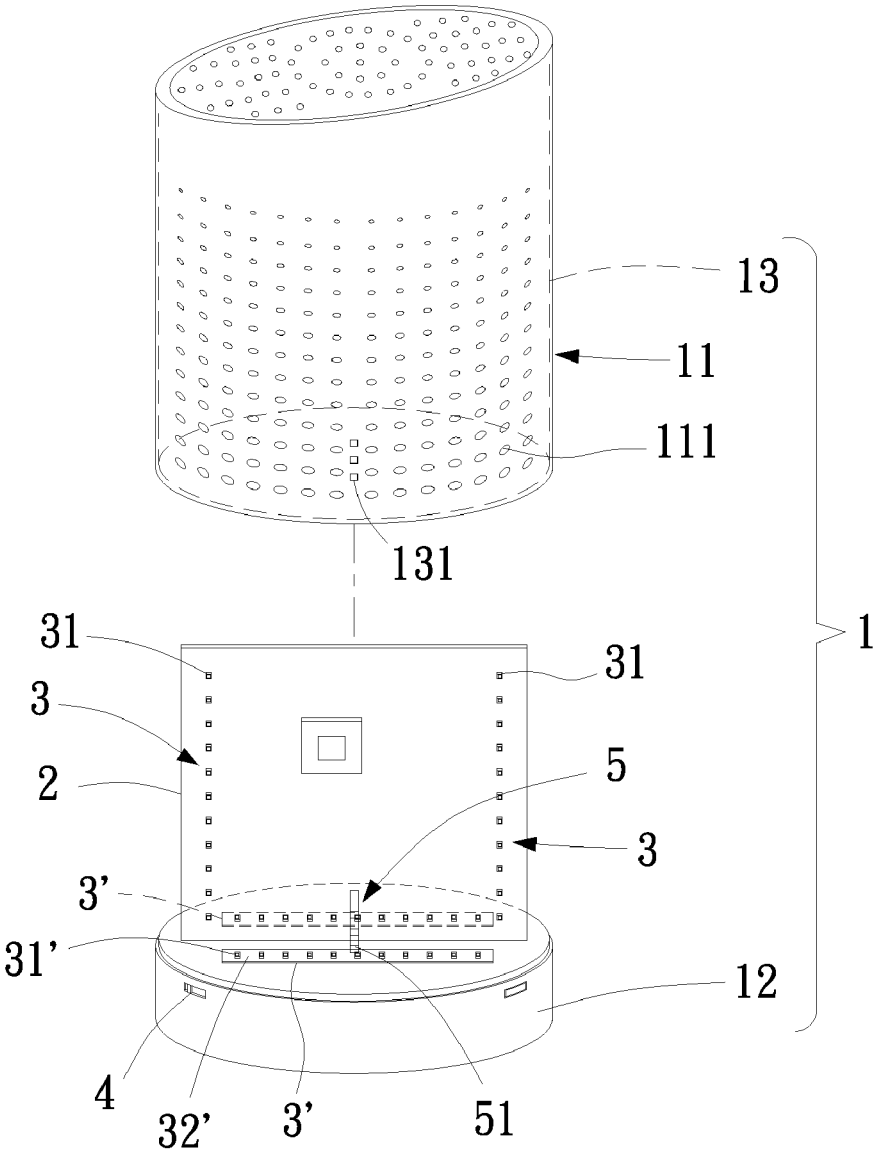
FIG. 6 is an exploded perspective view of a wireless network apparatus capable of illumination according to a third preferred embodiment of the present invention.
Figure 7:
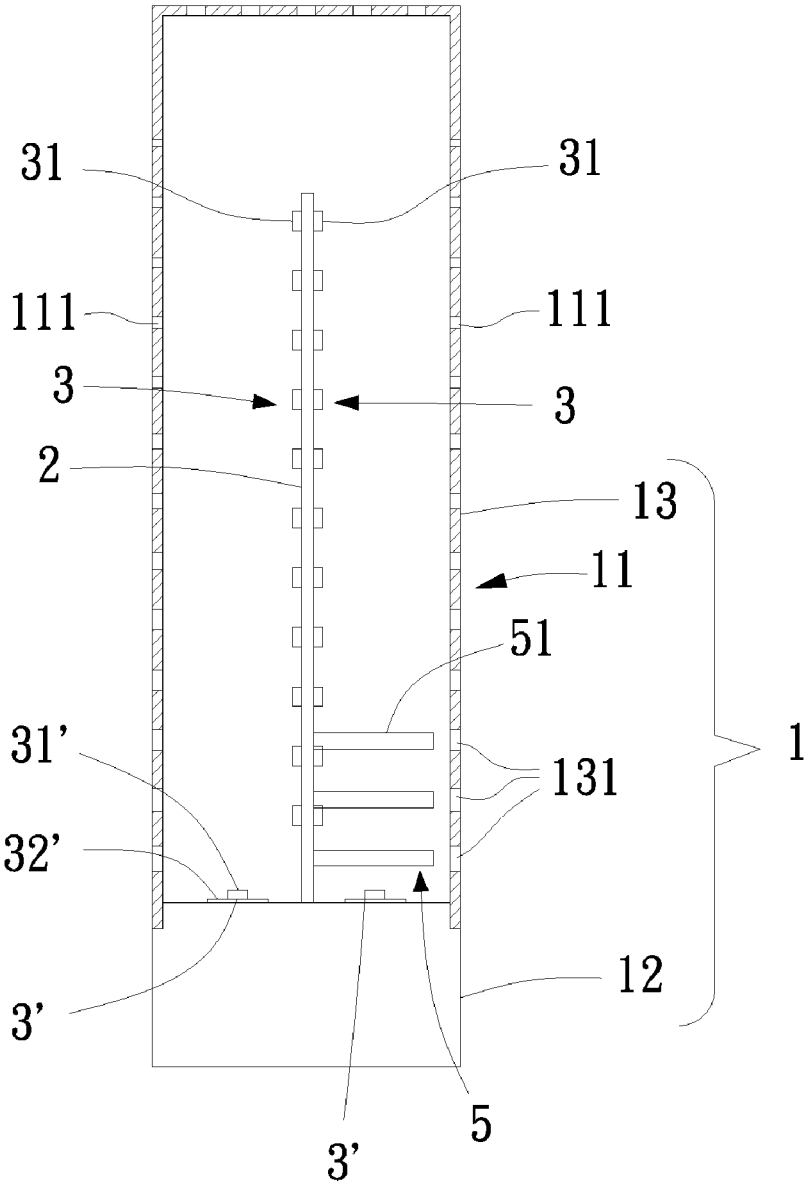
FIG. 7 is a cross-sectional view of the wireless network apparatus when assembled according to the third preferred embodiment of the present invention.

Referring to FIG. 6 and FIG. 7, in the third embodiment of the present invention, the light emitting unit 3 comprises at least one said first light-emitting diode 31 disposed on at least one of the front side and the rear side of the motherboard 2. The first light-emitting diodes 31 correspond in position to the light permeable portion 11 of the casing 1 and emit light that passes through the light permeable portion 11 to thereby provide a lighting function. In the third embodiment of the present invention, the light emitting unit 3' is disposed in the casing 1, and the light emitting unit 3' comprises the circuit substrate 32' and at least one said first light-emitting diodes 31' coupled to the circuit substrate 32'. The circuit substrate 32' is fixedly coupled to the casing 1 from inside, such that the at least one said first light-emitting diode 31' corresponds in position to the light permeable portion 11 of the casing 1. The first light-emitting diodes 31' equal the first light-emitting diodes 31 in that both emit light that passes through the light permeable portion 11 for providing a lighting function. In so doing, the wireless network apparatus of the present invention has a lighting function.

Referring to FIG. 1 through FIG. 7, to implement the wireless network apparatus having a lighting function according to the present invention, the casing 1 has a control switch 4. The control switch 4 is connected to a power circuit of the light emitting units 3, 3'. With the control switch 4, the light emitting units 3, 3' can be switched on or off, and can be adjusted in terms of brightness when switched between three brightness modes (brightest/moderate/dim).

In addition to a networking function, the wireless network apparatus of the present invention has a lighting function, as users can independently control the light emitting units 3, 3' in terms of operation (ON/OFF) and brightness (brightest/moderate/dim) by means of the control switch 4 disposed on the surface of the casing 1 such that the wireless network apparatuses (such as femtocells) provide illumination for people in daily life, whether on bed or at a desk. Hence, the wireless network apparatus of the present invention is not limited to a networking function, but also creates a brilliant home atmosphere, provides home illumination, increases the value-added, and boosts consumers' willingness to buy and install the wireless network apparatus.

Hence, the present invention meets the three requirements of patentability, namely novelty, non-obviousness, and industrial applicability. Regarding novelty and non-obviousness, the present invention discloses a wireless network apparatus having a light emitting unit therein for emitting lighting to provide home illumination, increase the value-added, and boost consumers' willingness to buy and install the wireless network apparatus. Regarding industrial applicability, the wireless network apparatus disclosed in the present invention can be implemented and manufactured according to the disclosure in the specifications and claims of the present invention, and products derived from the present invention meet market demands fully.

The foregoing embodiments are provided to illustrate and disclose the technical features of the present invention so as to enable persons skilled in the art to understand the disclosure of the present invention and implement the present invention accordingly, and are not intended to be restrictive of the scope of the present invention. Hence, all equivalent modifications and replacements made to the foregoing embodiments without departing from the spirit embodied in the disclosure of the present invention should fall within the scope of the present invention as set forth in the appended claims. Accordingly, the protection for the present invention should be defined by the appended claims.

What is claimed is:

1. A wireless network apparatus capable of illumination and effective in serving a networking function and a lighting function for improving illumination outside the apparatus, comprising:

a casing having a light permeable portion;

a motherboard disposed in the casing for providing the networking function;

a prompting unit disposed at the motherboard, the prompting unit electrically connected to the motherboard for generating a prompting signal in accordance with a status of the networking function being performed by the motherboard, wherein the prompting unit includes a plurality of second light-emitting diodes disposed on at least one of a front side and a rear side of the motherboard; and a light emitting unit disposed on the motherboard, positioned in a way to correspond in position to the light permeable portion, powered by the motherboard, and configured to emit light passing through the light permeable portion so as to provide the lighting function, wherein the light emitting unit includes a plurality of first light emitting diodes disposed on at least one of a front side and a rear side of the motherboard.

2. The wireless network apparatus of claim 1, wherein the light permeable portion comprises a plurality of through holes on a surface of the casing.

3. The wireless network apparatus of claim 1, wherein the light permeable portion is a light permeable shade disposed on the casing.

4. The wireless network apparatus of claim 1, wherein the light emitting unit comprises a circuit substrate and at least one first light-emitting diode coupled to the circuit substrate fixedly coupled to the motherboard and positioned in a way to correspond in position to the light permeable portion.

5. A wireless network apparatus capable of illumination and effective in serving a networking function and a lighting function for improving illumination outside the apparatus, comprising:

a casing having a light permeable portion;

a motherboard disposed in the casing for providing the networking function;

a prompting unit disposed at the motherboard, the prompting unit electrically connected to the motherboard for generating a prompting signal in accordance with a status of the networking function being performed by the motherboard, wherein the prompting unit includes a plurality of second light-emitting diodes for emitting a light ray functioning as the prompting signal; and a light emitting unit comprising a circuit substrate and at least one first light-emitting diode coupled to the circuit substrate fixedly coupled to the casing from inside, positioned in a way to correspond in position to the light permeable portion, and configured to emit light passing through the light permeable portion so as to provide the lighting function.

6. The wireless network apparatus of claim 5, wherein the light permeable portion comprises a plurality of through holes on a surface of the casing.

7. The wireless network apparatus of claim 5, wherein the light permeable portion is a light permeable shade disposed on the casing.

8. The wireless network apparatus of claim 5, wherein the light emitting unit further comprises at least one said first light-emitting diode disposed on at least one of a front side and a rear side of the motherboard, positioned in a way to correspond in position to the light permeable portion, and configured to emit light passing through the light permeable portion so as to provide the lighting function.

* * * * *